US008129325B2

(12) United States Patent
McKinnie et al.

(10) Patent No.: US 8,129,325 B2
(45) Date of Patent: Mar. 6, 2012

(54) STABILIZED PROPYL BROMIDE COMPOSITIONS

(75) Inventors: Bonnie Gary McKinnie, Magnolia, AR (US); Joseph H. Miller, Baton Rouge, LA (US)

(73) Assignee: Albermarle Corporation, Baton Rouge, LA (US)

( * ) Notice: Subject to any disclaimer, the term of this patent is extended or adjusted under 35 U.S.C. 154(b) by 758 days.

(21) Appl. No.: 11/577,899

(22) PCT Filed: Nov. 5, 2004

(86) PCT No.: PCT/US2004/037033

§ 371 (c)(1), (2), (4) Date: Apr. 25, 2007

(87) PCT Pub. No.: WO2006/052241

PCT Pub. Date: May 18, 2006

(65) Prior Publication Data

US 2009/0253608 A1 Oct. 8, 2009

(51) Int. Cl.
*C11D 17/00* (2006.01)

(52) U.S. Cl. ..... 510/407; 510/409; 510/411; 510/499

(58) Field of Classification Search ..... 510/411
See application file for complete search history.

(56) References Cited

U.S. PATENT DOCUMENTS

| | | | |
|---|---|---|---|
| 4,220,607 | A | 9/1980 | Dempf et al. |
| 4,385,192 | A | 5/1983 | Friedman et al. |
| 5,403,507 | A | 4/1995 | Henry |
| 5,492,645 | A | 2/1996 | Oshima et al. |
| 5,690,862 | A | 11/1997 | Moore, Jr. et al. |
| 5,707,954 | A | 1/1998 | Lee |
| 5,792,277 | A | 8/1998 | Shubkin et al. |
| 5,858,953 | A | 1/1999 | Aman et al. |
| 6,048,471 | A | 4/2000 | Henry |
| 6,049,014 | A | 4/2000 | Noonan et al. |
| 6,071,872 | A | 6/2000 | Miller et al. |
| 6,152,149 | A | 11/2000 | Miller et al. |
| 6,165,284 | A | 12/2000 | Shubkin |
| 6,258,770 | B1 | 7/2001 | Shubkin et al. |
| 6,350,395 | B1 | 2/2002 | Kuemin |
| 6,365,565 | B1 | 4/2002 | Thenappan et al. |
| 6,369,017 | B1 | 4/2002 | Shubkin et al. |
| 6,660,701 | B1 | 12/2003 | Degroot |
| 2002/0151447 | A1 | 10/2002 | Henry |

FOREIGN PATENT DOCUMENTS

| | | | |
|---|---|---|---|
| GB | 2024242 | A | 1/1980 |
| JP | 01292095 | | 11/1989 |
| JP | 08067643 | | 3/1996 |
| JP | 08-067643 | * | 12/1996 |
| JP | 08337795 | | 12/1996 |
| JP | 09302389 | | 11/1997 |
| JP | 10046197 | | 2/1998 |
| JP | 11293287 | | 10/1999 |
| WO | WO-98/50517 | A1 | 11/1998 |

OTHER PUBLICATIONS

Mayo et al., "The Addition of Hydrogen Bromide to Propylene", Journal of Am. Chem. Soc., 1947, vol. 69, pp. 1348-1351.

Mayo et al., "The Peroxide Effect in the Addition of Reagents to Unsaturated Compounds and in Rearrangement Reactions", Chem. Rev., 1940, vol. 27, pp. 351-412.

* cited by examiner

*Primary Examiner* — Necholus Ogden, Jr.

(74) *Attorney, Agent, or Firm* — Marcy M. Hoefling; Jeremy J. Kliebert; James A. Jubinsky

(57) ABSTRACT

Certain substituted phenolic compounds when used with or without 1,2-epoxides as the sole stabilizer components are very effective in stabilizing n-propyl bromide (NPB). In a standard commercially important 60° C. stability test, representative substituted phenolic compounds used pursuant to this invention, can enable NPB to pass the test even though present at levels of about 50 ppm (wt/wt) or less in NPB containing no other stabilizer additive component. In fact, amounts as low as 1 ppm have been found effective with various substituted phenolic compounds. In addition, it has been found that one of the preferred stabilizers of this invention—2,6-di-tert-butyl-p-cresol—even though higher boiling than NPB, left inconsequential amounts of residue at least throughout the range of 1 to 30 ppm (wt/wt). Also, it has been found that certain other preferred stabilizers of this invention can provide synergistically improved stability in passing the 60° C. stability test when used with at least one 1,2-epoxide, notably butylene oxide.

10 Claims, No Drawings

STABILIZED PROPYL BROMIDE COMPOSITIONS

REFERENCE TO RELATED APPLICATION

This application is the National Stage of International Patent Appl. No. PCT/US2004/037033, filed on Nov. 5, 2004, the disclosure of which is incorporated herein by reference.

BACKGROUND n-Propyl bromide (NPB) is an article of commerce. It is useful for various applications including cold cleaning of electrical and mechanical parts. Depending upon the processing used in its manufacture, products containing at least 90 wt % of NPB and as high as about 98-99 wt % of NPB are available in the marketplace. The major impurities tend to be isopropyl bromide and 1,2-dibromopropane.

In order to gain widespread commercial acceptance, it is desired that the NPB product pass a 60° C. stability test developed by a Japanese company. This test requires that NPB be kept for 30 days in a 60° oven with its acidity remaining below 5 ppm (calculated as HBr). The test is carried out in a Teflon polymer capped 100 mL glass bottle filled to the shoulder with NPB and without excluding air. To successfully pass the 60° C. stability test, a suitable stabilizer system is deemed necessary as pure NPB can and does release HBr under the test conditions along with the release of propene. The ability of an NPB composition to pass this test, enables the composition to be stored and shipped without encountering any significant decomposition. Also, the recipient can utilize the composition for various operations conducted at modest temperatures such as cold cleaning of electrical and mechanical parts, again without fear of encountering significant decomposition.

Unstabilized NPB has desirable volatility characteristics for various cold cleaning applications. Thus a stabilizer system for NPB not only must be effective in preventing excessive acidity development during the 60° C. stability test, but in addition, preferably should not contribute to unacceptable residue formation upon evaporation of the NPB.

BRIEF SUMMARY OF THE INVENTION

This invention involves, inter alia, the discovery that certain phenolic compounds are very effective in stabilizing NBP in the 60° C. stability test at extremely low concentrations. Indeed, tests have shown that representative phenolic compounds used pursuant to this invention, can enable NPB to pass the test even though present at levels below 50 ppm (wt/wt) in NPB containing no other stabilizer additive component. In fact, three preferred stabilizers of this invention were found effective in the 60° C. stability test at a concentration of 0.5 ppm (wt/wt). It has also been found that one of the preferred stabilizers of this invention—2,6-di-tert-butyl-p-cresol—was effective in the 60° C. stability test at a level of 1 ppm (wt/wt) and further, that even though higher boiling than NPB, this stabilizer left inconsequential amounts of residue at least throughout the range of 1 to 30 ppm, and probably would behave similarly at concentrations of up to at least about 50 ppm as well. In addition, it has been found that certain other preferred stabilizers of this invention can provide synergistically improved stability in passing the 60° C. stability test when used with at least one 1,2-epoxide, notably butylene oxide.

Without being bound by theory, it is worth noting that experimental work conducted in support of this invention indicates that the formation of acidity in n-propyl bromide especially during heat exposure is a free radical process, probably started by oxygen, and that propene and HBr are formed along with isopropyl bromide, the latter by recombination of propene and HBr. It is therefore theorized that impurity content of NPB is not the cause of its instability. It is thought that the substituted phenolic compound, when present in a stabilizing amount, minimizes or prevents the decomposition of n-propyl bromide to propene and HBr, while it is believed that the 1,2-epoxide reacts with HBr formed in the free-radical process so that the final product has very low acidity.

The enhanced stability of the NPB compositions of this invention as evidenced by their ability to pass this 60° C. stability test, not only ensures that the NPB compositions possess very desirable stability during storage and shipment, but additionally that the compositions can be effectively used in cold cleaning operations without need for additional stabilization. Moreover the compositions of this invention that leave inconsequential amounts or no amount of residue upon evaporation substantially increases their usefulness in cold cleaning operations. Accordingly other embodiments of this invention relate to improvements in end use applications of the NPB compositions of this invention.

The above and other features and embodiments of this invention will be still further apparent from the ensuing description and appended claims.

FURTHER DETAILED DESCRIPTION OF THE INVENTION

Pursuant to one embodiment of this invention, there is provided a solvent composition comprised of n-propyl bromide with which has been blended a stabilizing amount of not more than about 50 ppm (wt/wt), preferably of not more than about 5 ppm (wt/wt), and more preferably not more than about 2 ppm (wt/wt) of at least one mononuclear phenolic compound having one or two hydroxyl groups directly bonded to the benzene ring and a total of 6 to 16 carbon atoms in the molecule, said at least one phenolic compound being free of unsaturation other than the aromatic unsaturation of the benzene ring. Preferred mononuclear phenolic compounds are those which contain only carbon, hydrogen, and oxygen atoms in the molecule. A few non-limiting examples of such mononuclear phenolic compounds include phenol, catechol, resorcinol, hydroquinone, guaiacol, saligenin, carvacrol, thymol, o-cresol, m-cresol, p-cresol, o-ethylphenol, o-isopropylphenol, 2,6-diisopropylphenol, o-tert-butylphenol, p-tert-butylphenol, and o-cyclohexylphenol.

In a preferred embodiment, such mononuclear phenolic compound or combination of two or more such phenolic compounds is the sole stabilizer used in forming such solvent composition.

In another preferred embodiment there is provided a solvent composition comprised of n-propyl bromide with which has been blended a stabilizing amount of:

A) not more than about 50 ppm (wt/wt), preferably of not more than about 30 ppm (wt/wt), more preferably not more than 5 ppm (wt/wt), and still more preferably not more than about 2 ppm (wt/wt) of at least one mononuclear phenolic compound having one or two hydroxyl groups directly bonded to the benzene ring and a total of 6 to 16 carbon atoms in the molecule, said at least one phenolic compound being free of unsaturation other than the aromatic unsaturation of the benzene ring; and B) in the range of 10 to about 1000 ppm (wt/wt) and preferably in the range of about 100 to about 500 ppm (wt/wt) of at least one 1,2-epoxide.

In a further preferred embodiment, A) and B) constitute the sole stabilizers used in forming such solvent composition.

In yet another of its preferred embodiments this invention provides a solvent composition comprised of n-propyl bromide with which has been blended a stabilizing amount of up to about 50 ppm (wt/wt) of one or more substituted phenolic compounds of the formula

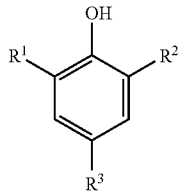

wherein:

A) $R^1$ and $R^2$ are both hydrogen atoms and $R^3$ is an alkoxy group containing in the range of 1 to 5 (preferably in the range of 1 to 3) carbon atoms; or B) $R^1$ is a hydroxyl group, $R^2$ is a hydrogen atom, and $R^3$ is an alkyl group containing in the range of 1 to 5 carbon atoms (preferably tert-butyl or tert-amyl); or C) $R^1$ and $R^2$ are both, independently, alkyl groups with the total number of carbon atoms in $R^1$ and $R^2$ being in the range of 5 to 10, with at least one of $R^1$ and $R^2$ being a tertiary alkyl group, and $R^3$ is a hydrogen atom; or D) $R^1$ and $R^2$ are both, independently, alkyl groups with the total number of carbon atoms in $R^1$ and $R^2$ being in the range of 5 to 10, with at least one of $R^1$ and $R^2$ being a tertiary alkyl group, and $R^3$ is an alkyl group containing 1 or 2 carbon atoms.

Preferably, the amount of the one or more substituted phenolic compounds of A), B), C), and/or D) used in forming the solvent composition will be in the range of about 0.25 to about 50 ppm (wt/wt) and preferably in the range of about 1 to about 5 ppm (wt/wt)

By "stabilizing amount" as used anywhere in this document, including the claims, is meant that the amount enables the solvent composition to pass the 60° C. stability test.

Preferably all of the above solvent compositions consist of n-propyl bromide containing one or more of the impurities that are formed therewith during the course of manufacture of the n-propyl bromide. In other words, the preferred solvent compositions are based on use of n-propyl bromide of a purity of at least 90% and more preferably of a purity of at least 98% and still more preferably of a purity of at least 99%, the balance in each case being one or more impurities resulting from the process by which the n-propyl bromide was prepared, and without addition of any other solvent to the product.

Non-limiting examples of the preferred substituted phenolic compounds of A), B), C), or D) above include 4-methoxyphenol, 4-ethoxyphenol, 4-propoxyphenol, 4-isopropoxyphenol, 4-butoxyphenol, 4-tert-butoxyphenol, 4-pentoxyphenol, 4-methyl-1,2-dihydroxybenzene, 4-ethyl-1,2-dihydroxybenzene, 4-propyl-1,2-dihydroxybenzene, 4-isobutyl-1,2-dihydroxybenzene, 4-tert-butyl-1,2-dihydroxybenzene, 4-tert-amyl-1,2-dihydroxybenzene, 2-methyl-6-tert-butylphenol, 2-ethyl-6-tert-butylphenol, 2-methyl-6-tert-amylphenol, 2-ethyl-6-tert-amylphenol, 2-isopropyl-6-tert-butylphenol, 2,6-di-tert-butylphenol, 2,6-di-tert-amylphenol, 2,4-dimethyl-6-tert-butylphenol, 2,4-diethyl-6-tert-butylphenol, 2-ethyl-6-tert-butylphenol, 2,4-dimethyl-6-tert-amylphenol, 2,4-diethyl-6-tert-amylphenol, 2-isopropyl-4-methyl-6-tert-butylphenol, 2,6-di-tert-butyl-4-methylphenol, 2,6-di-tert-butyl-4-ethylphenol, and 2,6-di-tert-amyl-4-methylphenol.

Of the above substituted phenolic compounds, use of 4-methoxyphenol, 4-tert-butyl-1,2-dihydroxybenzene, 2,6-di-tert-butylphenol, 2,6-di-tert-butyl-4-methylphenol, or a combination of any two or more of these is preferred. 2,6-Di-tert-butyl-4-methylphenol is particularly preferred.

Methods of preparing such stabilized solvent compositions so that they will pass the 60° C. stability test and most preferably will produce little, if any, residue upon distillation or evaporation, constitute additional embodiments of this invention.

This invention also provides in one of its embodiments an additive composition especially adapted for use in stabilizing n-propyl bromide compositions. Such additive compositions comprise (i) one or more substituted phenolic compounds of the above formula and (ii) one or more 1,2-epoxides wherein the weight ratio of (ii):(i) is in the range of about 0.2:1 to about 2500:1, and preferably in the range of about 20:1 to about 500:1, and wherein (i) and (ii) are the sole stabilizer components in such additive compositions. Such compositions may contain other ingredients such as an inert solvent or diluent, one or more surfactants, one or more dyes, or the like, provided however that no other stabilizer component is present in the additive composition.

Another embodiment of this invention is a solvent composition comprised of n-propyl bromide with which has been blended a stabilizing amount of (i) one or more substituted phenolic compounds of the above formula and (ii) one or more 1,2-epoxides. It is to noted that the term 1,2-epoxides does not mean that the ring must involve the carbon atoms in the 1- and 2-positions; instead this means that the epoxide (cyclic ether) has three atoms in the ring rather than 4 atoms in the ring. Typically the amount of the one or more substituted phenolic compounds of (i) used in forming the solvent composition will be in the range of about 0.25 to about 50 ppm (wt/wt) and preferably in the range of about 1 to about 5 ppm (wt/wt), and the amount of the one or more epoxides of (ii) used in forming the solvent composition will be in the range of about 10 to about 1000 ppm (wt/wt) and preferably in the range of about 100 to about 500 ppm (wt/wt).

Non-limiting examples of 1,2-epoxides which can be used in combination with the above substituted phenolic compounds include (a) alkylene oxides and/or cycloalkylene oxides of up to about 8 carbon atoms, e.g., propylene oxide, butylene oxide, pentene oxide, hexene oxide, heptene oxide, octene oxide, cyclopentene oxide, cyclohexene oxide, methyl-1,2-cyclopentene oxide, or mixtures composed of two or more alkylene oxides of up to about 8 carbon atoms; or (b) glycidyl ethers and/or glycidyl esters containing up to about 8 carbon atoms, e.g., glycidyl methyl ether, glycidyl isopropyl ether, glycidyl isobutyl ether, glycidyl pentyl ether, glycidyl methacrylate, glycidyl butyrate, glycidyl valerate, or mixtures composed of two or more glycidyl ethers and/or glycidyl esters containing up to about 8 carbon atoms; or (c) mixtures of at least one epoxide of category (a) and at least one epoxide of category (b). Of categories (a), (b), and (c), use with the above substituted phenolic compounds of one or more alkylene oxides and/or cycloalkylene oxides of category (a) is preferred, with use with the above substituted phenolic compounds of one or more alkylene oxides being more preferred. Still more preferred is use in these combinations of butylene oxide irrespective of whether the butylene oxide is 1,2-epoxybutane or 2,3-epoxybutane or a mixture of both.

Preferred compositions in which one or more 1,2-epoxides are used in combination with one or more of the above substituted phenolic compounds are 4-methoxyphenol, 4-tert-butyl-1,2-dihydroxybenzene, 2,6-di-tert-butylphenol or 2,6-di-tert-butyl-4-methylphenol. Especially preferred combinations appear in the examples hereinafter.

The solvent compositions with which the stabilizer(s) of this invention is/are blended is comprised of n-propyl bromide. Typically the predominate component (i.e., the component present in the greater or greatest amount will be n-propyl bromide. Preferably more than 50% by weight of the liquid solvent(s) of the solvent composition (i.e., excluding consideration of the additive(s) present therein) is n-propyl bromide (NPB). Preferably the solvent composition will contain at least 80 wt % of NPB and more preferably as high as about 98-99 wt % of NPB. The major impurities in such compositions are isopropyl bromide (IPB) and 1,2-dibromopropane (DBP). However, solvent compositions containing, exclusive of additives, (I) more than 50% by weight of NPB (preferably 80 wt % or more of NPB, and more preferably 90 wt % or more of NPB) of a purity of at least 90 wt % (preferably a purity of at least 98 wt %, and more preferably a purity of at least 99%) and (II) less than 50% by weight (preferably 20 wt % or less, and more preferably 10 wt % or less) of one or more liquid saturated hydrocarbons and/or other known solvent component(s) such as liquid halocarbons or liquid halohydrocarbons other than NPB, IPB, and DBP, may be stabilized pursuant to this invention. See in this connection U.S. Pat. No. 5,690,862, all disclosure of which is incorporated herein by reference, which patent describes certain preferred compositions of this type.

Methods of blending the components together are well-known to those of ordinary skill in the art. When preparing blends containing both at least one substituted phenolic compound and at least one 1,2-epoxide, these components can be separately blended with the solvent composition or an additive composition of this invention in which the stabilizer consists of a combination of at least one substituted phenolic compound and at least one 1,2-epoxide can be employed. The latter approach is preferred when it is desired to use both types of stabilizers as use of such a preformed additive simplifies the blending operation and minimizes the likelihood of errors in the blending operation.

An advantage of this invention is that effective stabilization can be achieved in the 60° C. stability test even though no more than 50 ppm of the substituted phenolic compound, preferably no more than 30 ppm of the substituted phenolic compound, and more preferably no more than 5 ppm of the substituted phenolic compound, and even more preferably no more than 2 ppm of the substituted phenolic compound, (all ppm values being as wt/wt) is incorporated into the solvent composition used. Indeed, 1 ppm or less of at least some of the substituted phenolic compounds can be used with NPB of sufficiently high purity as is shown in the Examples hereinafter. Moreover, because of such excellent effectiveness, it is not necessary to use any stabilizer component other than the one or more substituted phenolic compounds of categories A), B), C), and/or D) with or without one or more of the optionally-used 1,2-epoxides referred to above. In fact, it is especially preferred pursuant to this invention to have the solvent compositions thereof free of other stabilizers such as nitroalkanes (e.g., nitromethane, nitroethane, etc.), N-alkylmorpholines, amines, dioxanes, dioxolanes, and other known stabilizers for NPB. Thus in especially preferred embodiments of this invention the stabilizer system used in the solvent composition consists of the herein-described substituted phenolic compound(s) and optionally the herein-described 1,2-epoxide(s). In other words these especially preferred compositions are devoid of any stabilizer component other than one or more of the herein-described substituted phenolic compounds and optionally one or more of the herein-described 1,2-epoxides.

Surfactants, dyes, and other non-stabilizer components may be included in the compositions of this invention, provided no such component prevents the composition from passing the 60° C. stability test.

The following Examples are presented for the purposes of illustration and not limitation on the generic scope of the invention.

The gas chromatography analyses of n-propyl bromide in Examples 1, 2, and 5 were performed on a Hewlett-Packard 5890 gas chromatograph equipped with a split injector, flame ionization detector and a 30M×0.53 mm×3 μm DB-624 capillary column operating at 35° C. The temperature was held at 35° C. for 8 minutes, then raised at 10° C./min. to 230° C., final time 3 minutes. The column head pressure was 4.5 psig and the total flow of He was 75 mL/minute. An injection volume of 0.5 μl of neat sample was used.

The 60° C. stability test used in Examples 1-6 was conducted as follows: A quantity of about 160 grams of the n-propyl bromide (NPB) composition to be tested was placed in a 4 fluid ounce (118 mL) Boston Round screw cap bottle. The Teflon polymer-lined cap for the bottle was applied without excluding air from the free head space. The capped bottle was held in a 60° C. oven for 30 days without ever opening it. The sample was then allowed to cool to room temperature before determining acidity. The analysis for acidity involved shaking 80-120 grams of the cooled test sample with 30 to 50 mL of ultra pure water followed by phase separation and titration of the aqueous phase with 0.01 N NaOH to the phenolphthalein endpoint.

EXAMPLE 1

A composition of this invention was formed from purified n-propyl bromide (Sigma-Aldrich Company) having an acidity of 8 ppm (calculated as HBr) and containing by GC analysis 29 ppm of isopropyl bromide, 15 ppm of propene, and 26 ppm of water. Incorporated in this n-propyl bromide was 40 ppm of 2,6-di-tert-butyl-4-methylphenol. This composition was subjected to the 60° C. stability test. This product was found on completion of the test to have a final acidity of 4.9 ppm (calculated as HBr), 6.8 ppm of propene, and 18 ppm of isopropyl bromide (IPB). The unstabilized n-propyl bromide exhibited a final acidity of 91.0 ppm (calculated as HBr), and GC analysis indicated the presence of 282 ppm of propene and 400 ppm of isopropyl bromide.

EXAMPLE 2

Using the procedures of Example 1, a series of compositions of this invention were prepared from a silica gel treated n-propyl bromide (NPB) containing by GC analysis 6 ppm of isopropyl bromide and 28 ppm of propene. This NPB had an acidity of 0.6 ppm (calculated as HBr). The 60° C. stability test results and the compositions of this invention as well as the control composition tested are summarized in Table 1.

TABLE 1

| Compositions Tested | Final Acidity (calculated as HBr) | Final Propene Content, ppm | Final IPB Content, ppm |
|---|---|---|---|
| NPB + 1 ppm 2,6-di-tert-butyl-4-methylphenol | 1.1 | 27 | 9 |
| NPB + 1 ppm 2,6-di-tert-butyl-4-methylphenol + 250 ppm butylene oxide | 0.9 | 23 | 9 |
| NPB + 0.5 ppm 2,6-di-tert-butyl-4-methylphenol | 1.2 | 25 | 9[a] |
| NPB + 0.5 ppm 2,6-di-tert-butyl-4-methylphenol + 250 ppm butylene oxide | 0.8 | 22 | 9 |
| NPB + 0.5 ppm 4-methoxyphenol | 1.6 | 26 | 9 |
| NPB + 1 ppm 4-methoxyphenol + 250 ppm butylene oxide | 0.8 | 21 | 9 |
| NPB + 250 ppm butylene oxide | 10.4 | 109 | 10[b] |

[a]The analysis also indicated the presence of 0.6 ppm of bromoacetone, but no other impurity.
[b]The analysis also indicated the presence of 23 ppm of bromoacetone, plus other impurities.

EXAMPLE 3

The procedure of Example 2 was repeated using n-propyl bromide which had been water washed and dried over silica gel containing by GC analysis 163 ppm of isopropyl bromide, 60 ppm of propene, and 40 ppm of bromoacetone. Table 2 identifies the compositions tested and the results obtained in the 60° C. stability test. In Table 2 (and in subsequent Tables 3-5) "BA" stands for bromoacetone and "DBP" stands for 1,2-dibromopropane.

TABLE 2

| Compositions Tested | Final Acidity (calculated as HBr) | Final Propene Content, ppm | Final IPB Content, ppm | Final BA Content, ppm | Final DBP Content, ppm |
|---|---|---|---|---|---|
| NPB + 1 ppm 4-tert-butyl-1,2-dihydroxybenzene | 1.2 | 53 | 175 | 61 | 21 |
| NPB + 1 ppm 2,6-di-tert-butylphenol | 1.2 | 52 | 175 | 77 | 22 |
| NPB + 1 ppm 4-tert-butyl-1,2-dihydroxybenzene + 250 ppm butylene oxide | 1.0 | 54 | 178 | 63 | 20 |
| NPB + 1 ppm 2,6-di-tert-butylphenol + 250 ppm butylene oxide | 0.8 | 50 | 176 | 66 | 20 |
| NPB + 0.5 ppm 4-tert-butyl-1,2-dihydroxybenzene | 1.4 | 47 | 175 | 70 | 20 |
| NPB + 0.5 ppm 2,6-di-tert-butylphenol | 1.8 | 46 | 174 | 69 | 21 |
| NPB with no stabilizer | 34.0 | 143 | 176 | 118 | 101 |

EXAMPLE 4

The procedure of Example 2 was repeated using n-propyl bromide having an acidity of 2 ppm (calculated as HBr) and containing by GC analysis 263 ppm of isopropyl bromide and 2 ppm of propene. Table 3 identifies the compositions tested and the results obtained in the 60° C. stability test.

TABLE 3

| Compositions Tested | Final Acidity (calculated as HBr) | Final Propene Content, ppm | Final IPB Content, ppm | Final BA Content, ppm | Final DBP Content, ppm |
|---|---|---|---|---|---|
| NPB + 0.5 ppm 4-tert-butyl-1,2-dihydroxybenzene | 1.4 | 5 | 280 | 0.00 | 0.00 |
| NPB + 0.5 ppm 2,6-di-tert-butyl-4-methylphenol | 1.3 | 3 | 280 | 0.00 | 0.00 |
| NPB + 0.5 ppm 4-methoxyphenol | 1.3 | 3 | 277 | 0.00 | 0.00 |

TABLE 3-continued

| Compositions Tested | Final Acidity (calculated as HBr) | Final Propene Content, ppm | Final IPB Content, ppm | Final BA Content, ppm | Final DBP Content, ppm |
|---|---|---|---|---|---|
| NPB + 0.5 ppm 2,6-di-tert-butylphenol | 277 | 122 | 787 | 243 | 20 |
| NPB + 0.5 ppm 4-tert-butyl-1,2-dihydroxybenzene + 250 ppm butylene oxide | 1.4 | 6 | 276 | 0.00 | 0.00 |
| NPB + 0.5 ppm 2,6-di-tert-butyl-4-methylphenol + 250 ppm butylene oxide | 1.5 | 4 | 278 | 0.00 | 0.00 |
| NPB + 0.5 ppm 4-methoxyphenol + 250 ppm butylene oxide | 1.0 | 3 | 280 | 0.00 | 0.00 |
| NPB + 0.5 ppm 2,6-di-tert-butylphenol + 250 ppm butylene oxide | 1.8 | 14 | 278 | 0.00 | 0.00 |
| NPB with no stabilizer (2 separate tests) | 273; 265 | 187; 16 | 955; 820 | 167; 389 | 25; 47 |
| NPB + 250 ppm butylene oxide | 9.7 | 88 | 277 | 24 | 4 |

EXAMPLE 5

The procedure of Example 2 was repeated using n-propyl bromide having an acidity of 6 ppm (calculated as HBr) containing by GC analysis 84 ppm of isopropyl bromide and 1 ppm of propene. Table 4 identifies the compositions tested and the results obtained in the 60° C. stability test. In Table 4 (and also in subsequent Table 5) "nd" means no determination, in as much as no GC analysis was made of that particular test product.

TABLE 4

| Compositions Tested | Final Acidity (calculated as HBr) | Final Propene Content, ppm | Final IPB Content, ppm | Final BA Content, ppm | Final DBP Content, ppm |
|---|---|---|---|---|---|
| NPB + 0.1 ppm 4-tert-butyl-1,2-dihydroxybenzene | 249 | 418 | 735 | 164 | 31 |
| NPB + 0.1 ppm 4-tert-butyl-1,2-dihydroxybenzene + 250 ppm butylene oxide | 3.2 | 3 | 102 | 0.00 | 0.00 |
| NPB + 0.3 ppm 4-tert-butyl-1,2-dihydroxybenzene | 276 | 400 | 863 | 112 | 20 |
| NPB + 0.1 ppm 4-methoxyphenol | 258 | nd | nd | nd | nd |
| NPB + 0.1 ppm 4-methoxyphenol + 250 ppm butylene oxide | 3.3 | 5 | 106 | 0.00 | 0.00 |
| NPB + 0.3 ppm 4-methoxyphenol | 267 | nd | nd | nd | nd |
| NPB + 0.1 ppm 2,6-di-tert-butyl-4-methylphenol | 224 | nd | nd | nd | nd |
| NPB + 0.1 ppm 2,6-di-tert-butyl-4-methylphenol + 250 ppm butylene oxide | 9.0 | 107 | 104 | 17 | 1[a] |
| NPB + 0.3 ppm 2,6-di-tert-butyl-4-methylphenol | 235 | nd | nd | nd | nd |
| NPB + 0.5 ppm 4-tert-butyl-1,2-dihydroxybenzene | 278 | nd | nd | nd | nd |
| NPB + 0.5 ppm 4-methoxyphenol | 283 | nd | nd | nd | nd |
| NPB + 0.5 ppm 2,6-di-tert-butyl-4-methylphenol | 277 | nd | nd | nd | nd |
| NPB with no stabilizer | 267 | 398 | 616 | 100 | 30 |

[a]The analysis also indicated the presence of unidentified heavies.

EXAMPLE 6

The procedure of Example 2 was repeated using n-propyl bromide containing by GC analysis 196 ppm of isopropyl bromide and 2 ppm of propene. Table 5 identifies the compositions tested and the results obtained in the 60° C. stability test.

TABLE 5

| Compositions Tested | Final Acidity (calculated as HBr) | Final Propene Content, ppm | Final IPB Content, ppm | Final BA Content, ppm | Final DBP Content, ppm |
|---|---|---|---|---|---|
| NPB + 1 ppm 4-tert-butyl-1,2-dihydroxybenzene | 0.7 | 2 | 199 | 0.00 | 0.00 |
| NPB + 1 ppm 4-methoxyphenol | 9.1 | 36 | 197 | 0.00 | 0.00 |
| NPB + 1 ppm 2,6-di-tert-butyl-4-methylphenol | 0.7 | 3 | 198 | 0.00 | 0.00 |
| NPB + 1 ppm 4-tert-butyl-1,2-dihydroxybenzene + 250 ppm butylene oxide | 0.5 | 2 | 195 | 0.00 | 0.00 |
| NPB + 1 ppm 4-methoxyphenol + 250 ppm butylene oxide | 0.8 | 2 | 199 | 0.00 | 0.00 |
| NPB + 1 ppm 2,6-di-tert-butyl-4-methylphenol + 250 ppm butylene oxide | 0.7 | 2 | 196 | 0.00 | 0.00 |
| NPB with no stabilizer (2 separate tests) | 127; 194 | 347; 271 | 560; 437 | 129; 97 | 50; 33[a] |

[a]The analysis also indicated the presence of unidentified heavies.

From Examples 2-6 it can be seen that the substituted phenolic stabilizers of the invention when used as the sole stabilizer in various NPB solvent compositions at a concentration of 1 ppm and even at certain concentrations below 1 ppm, enabled the composition to pass the 60° C. stability test. It can also be seen from Examples 2-6 that at least in some cases the inclusion of a 1,2-epoxide such as butylene oxide, can provide synergistic improvements in the 60° C. stability test.

In Example 7 a non-volatile residue test was used. The procedure of this test is as follows: To a dry evaporation dish of known weight is added 100 mL of the sample to be tested. The dish is weighed again and placed under a heat lamp until the sample is evaporated to dryness. The dish is placed in a 105° C. oven for 1 hour, cooled in a dessicator, and weighed a final time. Non-volatile residue, in parts per million wt/wt, is calculated from the ratio of the final net weight to the starting net weight.

EXAMPLE 7

In a group of tests conducted using an unstabilized commercially available n-propyl bromide, various concentrations of 2,6-di-tert-butyl-4-methylphenol (BHT) were blended therewith and duplicate samples of the resultant stabilized n-propyl bromide compositions were tested for non-volatile residue using the non-volatile residue test described above. The compositions tested and the results obtained are summarized in Table 6.

TABLE 6

| Sample | BHT, ppm | Non-volatile Residue, ppm | Non-volatile Residue Average, ppm |
|---|---|---|---|
| A | 0.00 | 1.3; 2.3 | 1.8 |
| B | 1 | 2.9; 1.4 | 2.15 |
| C | 5 | 2.4; 1.7 | 2.05 |
| D | 15 | 1.5; 2.2 | 1.85 |
| E | 30 | 1.4; 1.4 | 1.4 |

From the results shown in Tables 1-6, it can be seen that this invention makes it possible to pass the 60° C. stability test and at the same time provide compositions which leave insignificant amounts of non-volatile residues. In any given case where an unfavorable result may be achieved, all that is required is to adjust the amount or makeup of the stabilizer of this invention being used so that it provides the requisite stability and preferably the minimal non-volatile residue achievable by the practice of this invention.

In the course of the experimental work conducted in support of this invention it was found that pure NPB (<30 ppm each of isopropyl bromide, propene, and water, no other significant impurities) was unstable, forming 70-200+ ppm HBr during the 60° C. stability test. Analysis of NPB after conducting that test showed large amounts of propene (up to 400 ppm) and isopropyl bromide (up to 1100 ppm) had also formed, as well as about 100 ppm each bromoacetone and 1,2-dibromopropane. Evidently the HBr and propene are formed from NPB, and the isopropyl bromide is formed in an ionic reaction of HBr with propene. This is confirmed by the observation that in tests where butylene oxide was added, propene would still form but not isopropyl bromide, since the HBr reacted with the butylene oxide faster than it reacted with propene.

It is to be understood that the ingredients referred to by chemical name or formula anywhere in the specification or claims hereof, whether referred to in the singular or plural, are identified as they exist prior to coming into contact with another substance referred to by chemical name or chemical type (e.g., a solvent, a diluent, or etc.). It matters not what preliminary chemical changes, transformations and/or reactions, if any, take place in the resulting mixture or solution as such changes, transformations and/or reactions are the natural result of bringing the specified reactants and/or components together under the conditions called for pursuant to this disclosure. Thus the reactants and other materials are identified as ingredients to be brought together in connection with forming a mixture or composition of the invention. Also, even though the claims hereinafter may refer to substances, components and/or ingredients in the present tense ("comprises", "is", etc.), the reference is to the substance or ingredient as it existed at the time just before it was first contacted, blended or mixed with one or more other substances or ingredients in accordance with the present disclosure. The fact that the substance or ingredient may have lost its original identity through a chemical reaction or transformation or complex formation or assumption of some other chemical form during the course of such contacting, blending or mixing operations, is thus wholly immaterial for an accurate understanding and appreciation of this disclosure and the claims thereof.

Except as may be expressly otherwise indicated, the article "a" or "an" if and as used herein is not intended to limit, and should not be construed as limiting, a claim to a single element to which the article refers. Rather, the article "a" or "an" if and as used herein is intended to cover one or more such elements, unless the text expressly indicates otherwise.

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

The invention claimed is:

1. A composition formed from components consisting of n-propyl bromide and not more than about .0005 wt % of at least one mononuclear phenolic compound having one or two hydroxyl groups directly bonded to the benzene ring and a total of 6 to 16 carbon atoms in the molecule, said at least one phenolic compound being free of unsaturation other than the aromatic unsaturation of the benzene ring.

2. A composition as in claim 1 in which said phenolic compound has the formula

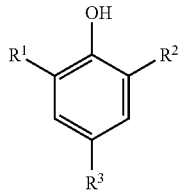

and wherein:

A) $R^1$ and $R^2$ are both hydrogen atoms and $R^3$ is an alkoxy group containing in the range of 1 to 5 carbon atoms; or B) $R^1$ is a hydroxyl group, $R^2$ is a hydrogen atom, and $R^3$ is an alkyl group containing in the range of 1 to 5 carbon atoms; or C) $R^1$ and $R^2$ are both, independently, alkyl groups with the total number of carbon atoms in $R^1$ and $R^2$ being in the range of 5 to 10, with at least one of $R^1$ and $R^2$ being a tertiary alkyl group, and $R^3$ is a hydrogen atom; or D) $R^1$ and $R^2$ are both, independently, alkyl groups with the total number of carbon atoms in $R^1$ and $R^2$ being in the range of 5 to 10, with at least one of $R^1$ and $R^2$ being a tertiary alkyl group, and $R^3$ is an alkyl group containing 1 or 2 carbon atoms.

3. A composition as in claim 2 wherein said one or more substituted phenolic compounds are of the formula in claim 2 wherein $R^1$ and $R^2$ are both hydrogen atoms and $R^3$ is an alkoxy group containing in the range of 1 to 5 carbon atoms.

4. A composition as in claim 2 wherein said one or more substituted phenolic compounds are of the formula in claim 2 wherein $R^1$ is a hydroxyl group, $R^2$ is a hydrogen atom, and $R^3$ is an alkyl group containing in the range of 1 to 5 carbon atoms.

5. A composition as in claim 2 wherein said one or more substituted phenolic compounds are of the formula in claim 2 wherein $R^1$ and $R^2$ are both, independently, alkyl groups with the total number of carbon atoms in $R^1$ and $R^2$ being in the range of 5 to 10, with at least one of $R^1$ and $R^2$ being a tertiary alkyl group, and $R^3$ is a hydrogen atom.

6. A composition as in claim 2 wherein said one or more substituted phenolic compounds are of the formula in claim 2 wherein $R^1$ and $R^2$ are both, independently, alkyl groups with the total number of carbon atoms in $R^1$ and $R^2$ being in the range of 5 to 10, with at least one of $R^1$ and $R^2$ being a tertiary alkyl group, and $R^3$ is an alkyl group containing 1 or 2 carbon atoms.

7. A composition as in claim 2 wherein said one or more substituted phenolic compounds is 4-methoxyphenol, 4-tert-butyl-1,2-dihydroxybenzene, 2,6-di-tert-butylphenol, 2,6-di-tert-butyl-4-methylphenol, or a combination of any two or more of these substituted phenolic compounds.

8. A composition formed from components consisting of n-propyl bromide, not more than about 0.0005 wt % of at least one mononuclear phenolic compound having one or two hydroxyl groups directly bonded to the benzene ring and a total of 6 to 16 carbon atoms in the molecule, said at least one phenolic compound being free of unsaturation other than the aromatic unsaturation of the benzene ring, and in the range of about 0.001 to about 0.1 wt % of one or more 1,2-epoxides.

9. A composition as in claim 8 wherein said one or more 1,2-epoxides are one or more alkylene oxides and/or cycloalkylene oxides of up to about 8 carbon atoms.

10. A composition as in claim 8 wherein said one or more 1,2-epoxides are one or more glycidyl ethers and/or glycidyl esters containing up to about 8 carbon atoms.

* * * * *